United States Patent [19]

Heidan et al.

[11] Patent Number: 4,996,854

[45] Date of Patent: Mar. 5, 1991

[54] APPARATUS FOR TREATING TEXTILE MATERIALS

[76] Inventors: Klaus Heidan, Dohmenstr. 29, D-4150 Krefeld; Klaus Meisen, Wiemeshütte 27, D-4154 Tönisvorst; Peter Farber, Biebricherstr. 4, D-4150 Krefeld; Bernhard Miunske, Cracauer Str. 75, D-4150 Krefeld; Wolfgang Tschirner, Seidenstrasse 115, D-4154 Tönisvorst, all of Fed. Rep. of Germany

[21] Appl. No.: 386,452

[22] Filed: Jul. 27, 1989

[30] Foreign Application Priority Data

| | | | |
|---|---|---|---|
| Jul. 27, 1988 | [DE] | Fed. Rep. of Germany | 3825452 |
| Oct. 11, 1988 | [DE] | Fed. Rep. of Germany | 3834598 |
| Jul. 17, 1989 | [EP] | European Pat. Off. | 89113088.2 |

[51] Int. Cl.[5] ..... D06B 3/12; D06B 21/02

[52] U.S. Cl. ..... 68/5 D; 68/5 E; 68/205 R

[58] Field of Search ..... 68/5 D, 5 E, 205 R

[56] References Cited

U.S. PATENT DOCUMENTS

| | | | |
|---|---|---|---|
| 1,907,429 | 5/1933 | Masland, 2nd | 68/5 D X |
| 2,441,992 | 5/1948 | Converse | 68/5 E |
| 3,950,967 | 4/1976 | Davies et al. | 68/5 D |
| 4,873,846 | 10/1989 | Talbert, Jr. | 68/5 E |

FOREIGN PATENT DOCUMENTS

| | | | |
|---|---|---|---|
| 2702908 | 7/1978 | Fed. Rep. of Germany | 68/5 D |
| 2910572 | 9/1980 | Fed. Rep. of Germany | 68/5 E |
| 639157 | 10/1983 | Switzerland | 68/5 E |

*Primary Examiner*—Philip R. Coe

*Attorney, Agent, or Firm*—Hill, Van Santen, Steadman & Simpson

[57] ABSTRACT

Apparatus for the treatment, particularly bleaching, washing, dyeing, boiling, desizing, mercerizing, etc., of a textile material, comprising a container in which the material to be treated is guided over a plurality of rollers and is exposed to the action of a liquor, comprising at least one applicator arranged in the container neighboring the web of the material, said applicator having an admission for the liquor to be applied onto the material, having a means for supplying thermal energy for the formation of an aerosol of the liquor and having a discharge means for high-pressure application of the aerosol onto the textile material conducted past the applicator, and comprising a steamer for steam treatment of the textile material charged with the liquor, characterized in that, following a sluice (64), the steamer (90) is arranged spatially separated from the container (40) that accepts the applicator or applicators (10); and in that the container (40) that accepts the applicator or applicators (10) is provided with a means for steam rinsing; further, a method implementable with this apparatus (FIG. 5).

41 Claims, 6 Drawing Sheets

APPARATUS FOR TREATING TEXTILE MATERIALS

The invention is directed to an apparatus for treating a textile material which apparatus includes a container in which the material to be treated is guided over a plurality of rollers and is exposed to the influence of a liquor, at least one applicator being arranged in the container adjacent to the web of the material and having an admission for the liquor to be applied onto the material, means for supplying thermal energy for the formation of an aerosol of the liquor and having a discharge means for the high-pressure application of the aerosol onto the textile material conducted past the applicator, and a steamer for steam treatment of the textile material charged with the liquor. The invention is also directed to a method for the treatment, particularly bleaching, washing, dyeing, boiling, desizing, mercerizing, etc., of a textile material wherein the material is treated with a chemical liquor in the apparatus.

In known apparatus for bleaching, washing, dyeing, boiling, desizing, mercerizing, etc., a textile material, this textile material is conducted through baths formed in the container wherein the textile material is saturated with the liquor. In order to enable an adequate reaction time of the liquor, a plurality of upper and lower rollers over which the textile material is conducted before it departs the container are arranged following the baths as seen in through put direction.

A shorter dwell time of the textile material in the container derives when, as is the case in the apparatus of the species (European patent No. 545,681) the textile material is charged with an aerosol of the liquor and is then subjected to a steam treatment of a known type that allows the applied liquor to act on the textile material. The treatment agent referred to as "liquor" (usually, aqueous solutions or dispersions of suitable chemicals) is thereby applied to the textile material to be treated as an aerosol under high pressure, whereby the formation of the aerosol that is applied onto the textile material under high (vapor) pressure is effected by the application of thermal energy.

In the apparatus of the species, the steamer is integrated in the container that accepts the applicators, whereby the volume of the container is necessarily relatively large. Since the boiling point of, for example, a hydrogen peroxide solution lies above the boiling point of pure water and heated cover plates or the like that are hotter than 100° C. lead to an evaporation of the water, and thus, to a concentrating of, for example, the peroxide in the container, there is an explosion risk in the known apparatus because the peroxide tends to spontaneously decompose above a defined limit concentration and limit temperature. This can particularly occur given the presence of metal ions acting as catalysts that are situated in the material web. Oxygen, water and heat arise in the decomposition of the hydrogen peroxide. The heat leads to the evaporation of the water. The increase in volume due to the decomposition thereby amounts to up to 4,000 times the original volume. The explosion risk is thus considerable.

SUMMARY OF THE INVENTION

The object of the invention is to create an apparatus of the species wherein such an explosion [or:deflagration] risk is not present.

In accord with the invention, this object is achieved with respect to the apparatus by the features of a sluice or lock wherein the steamer is arranged spatially separated from the application container that accepts the applicator or applicators; and in that the application container that accepts the applicator or applicators is provided with a means for steam rinsing. Particularly preferred embodiments of the apparatus of the invention are the subject matter of dependent apparatus claims. With respect to the method, the object underlying the invention is achieved by the features of applying the liquid, which may be either a single chemical or different chemicals, from either a single or both sides at either a single or multiple location, onto the material with a subsequent dwell in the steamer for reaction purposes ensues, whereby identical chemicals are preferably provided for opposite sides of the textile material. Particularly preferred embodiments of the method of the invention are that the steaming is followed by at least one further single-sided or both-sided chemical application, whereby the textile material is directly supplied to following handling processes following the last chemical application, preferably after only a short dwell time in the steamer and that the dwell times in the steamer between the individual chemical applications are variable.

The invention is based on the perception that one can successfully oppose the explosion risk present in the apparatus of the species due to concentrating of, for example, peroxides in that the container in which the applicators are arranged is spatially separated from the actual steamer, so that the volume of the space that accepts the applicators can be relatively small. In accord with the invention, further, the container accepting the applicators is always steam-rinsed, so that the chemicals, particularly the peroxide, that have/has not proceeded onto the weave and threatens to concentrate are/is constantly eliminated. An explosion is thus reliably prevented.

When the apparatus for supplying thermal energy that, first, effects the formation of the aerosol and, second, manages the adequate application pressure is fashioned for the introduction of water or, respectively, steam residing under excess pressure, as can be provided in the invention, then the high thermal energy of the water residing under excess pressure or, respectively, of the super-pressurized steam effects an evaporation of the liquor upon formation of an aerosol. When the applicator is formed by at least two unary nozzles directed onto the same point, as can likewise be inventively provided, the supply of thermal energy to the liquor (and, thus, the activation) occurs immediately on the textile material. Given such a fashioning, the liquor is applied onto the material through the one nozzle and the steam is applied onto the material through the other nozzle, whereby the thermal and the kinetic energy of the steam effect a penetration of the liquor into the material and the activation thereof.

A uniform charging of the textile material with the aerosol of the liquor can be particularly achieved when, as inventively proposed, a plurality of applicators arranged side-by-side essentially transversely relative to the conveying direction of the material are provided, whereby the aerosol jets emerging from the nozzles overlap on the material to be treated. When the individual applicators are provided with controllable valves, as can be likewise provided in the invention, then a controlled charging of the textile material to be treated can be achieved dependent on the position and width thereof. An adaptation to the respective objective can be achieved in that the distance between the applicator or, respectively, the applicators and the web of the material is adjustable.

The applicator or applicators is/are preferably arranged and directed such that the material is charged with the liquor when lying against one of the rollers. This roller can thereby be a sieve drum i.e., a roller whose circumference is formed by a sieve. This allows one to anticipate a better penetration of the liquor and/or of the steam into the material since the water can emerge from the material in the direction toward the sieve drum. This drum can also be fashioned heatable, this contributing to a further activation of the liquor applied onto the material.

Various references (German patent No. 47 553, German patent No. 885 534 EP No. 0 139 617 A2) in fact already disclose various types of applicators, even for wet-treatment of textile material; the separation of the steamer from a constantly steam-rinsed application container that is critical to the invention, however, is not addressed therein. These publications likewise contain no teaching of an especially preferred embodiment of the invention wherein an activation of the aerosol or, respectively, of the liquor is initially achieved on the textile web on the basis of polynary nozzles with external mixing or by employing two unary nozzles directed onto one point of the textile material.

A particular embodiment of the invention is concerned with the problem that the chemical liquor sprayed from the nozzle onto the material does not proceed entirely onto the textile material; on the contrary, a part remains in the free vapor space as chemical fog. Even when the applicators, as inventively provided, precede the steamer in a separate application container, whereby a constant steam rinsing of the application container ensues, the chemical fog can nonetheless stick to the walls and to the cover of the application container. After combining to form larger drops, these can drop down onto the material and cause spots there that can be seen on the finished goods. Insofar as they are lead in the steam space, the pipelines for the chemical liquor leading to the applicators—even given encapsulation in a housing—are colder than the surrounding steam atmosphere and lead to the formation of condensate, wherefrom drip spots can likewise result on the goods. Painting inside surfaces of the application container is not a feasible way of eliminating this problem because of the above-discussed risk of explosions in the application container.

In the described application method wherein the mixture of aqueous chemical liquor and steam is applied onto the moving material web with nozzles in the application container in a steam atmosphere at about 100° C. and about 1 bar pressure, whereby the application is undertaken at the discharge of a guide roller and preferably over the entire width of the material with nozzles arranged next to one another, namely preferably with similar geometry for both sides of the textile material in order to achieve an evensided effect of the process, the invention therefore preferably provides that the sluice situated between the application container and the steamer be fashioned in the form of a spill shaft closed from the surrounding atmosphere through which the material and the steam flowing over into the application container from the steamer under slight excess pressure are guided in co-current or counter-current flow.

This not only has the advantage that the excess steam of the steamer is not lost but is also co-employed for rinsing the application container; rather, it is also guaranteed that the textile material permanently dwells at 100° C. in steam atmosphere, i.e., also upon transfer from the application container into the steamer, and does not come into contact with colder air, even for a brief time, wherefrom a cooling of the material and a deterioration of the achieved treatment effect could result.

The formation of droplets is already considerably reduced by the above-described measure. A further improvement can be achieved in that the chemical droplets are removed from the mixture of air-steam, chemical droplets extracted at the output of the application container before the mixture is supplied to the ambient atmosphere. This ensues partially on the basis of the centrifugal force in radial ventilators employed as extraction fans. In addition, a commercially available demister can follow. This thereby involves a weave of stainless steel or plastic wire through which the mixture flows, preferably vertically. Whereas the gaseous constituents can freely move in the gaps of the weave, the droplets collect on the wires as a consequence of the forces of gravity, combined to form larger droplets, ultimately drip vertically down and are eliminated. The eliminated liquor is preferably recirculated.

For overcoming the "dripping problem", i.e., for farther-reaching avoidance of the dripping of liquor from the walls of the application container or—even if encapsulated—liquor conduits, the invention further teaches that all walls except the bottom walls in the application container be fashioned vertically or inclined at at least 30° relative to the horizontal through a maximum of 90° relative to the horizonal. What is thereby achieved is that attaching droplets that combine to form larger drops do not drip down but run along the inside wall of the application container and thus can be eliminated in a way that is not harmful for the material. A covering, for example a sheet metal ply, above the nozzles of the applicators prevents the liquor that runs down from proceeding into the nozzle jet and leading to disturbances there. The nozzles themselves only have their nozzle end situated in the steam space, whereas the rest such as nozzle body and connecting conduits are situated in the airspace at ambient temperature. Apart from the nozzle jet orifice, the nozzle is sealed from the steam space of the application container. The advantage of this design is comprised in the free accessibility of all conduits, screwed connections, valves, etc., without dismantling. Maintenance and repair are considerably simplified. A suitable shaping of the application container also makes it possible to attach the nozzle cross pieces in chamber-like indented portions of the application container wall such that the nozzle end is situated at an optimum distance from the textile material, whereby inside walls of the application container that adjoin the nozzle end and proceed at a slant simultaneously guarantee an elimination of condensing chemical liquor without the risk of dripping onto the textile material, as already set forth. It should be emphasized that a dripping of condensed fog onto the material or onto the rollers via which the textile material guided and which could transfer drops onto the material is completely prevented in an especially advantageous way when the liquor conduits lie outside of the interior of the application container, i.e. the nozzles of the applicators have their nozzle ends sealed from the interior of the application container, and, further, when no material web proceeds under the liquor conduits, (or the encapsulation thereof).

In a preferred embodiment of the invention, the entire nozzle cross piece is replaceable as an integrated structural unit. The fastening and sealing ensue via rapid-action closures so that a nozzle cross piece can be replaced with only a short production outrage in case of a malfunction at the nozzles. From matching to specific, liquor-conditioned application conditions, for example given changing viscosity of the chemical liquor employed, the nozzles can also be replaced by replacing the nozzle crosspiece with one having a different jet characteristic. Different distances between the nozzle end and the textile web can also be achieved with the replacement of the nozzle crosspiece.

Moreover, it can also be provided in the invention that the steamer is followed by a further application container, whereby the textile material is initially returned from this further application container into the steamer and, in any case, is only conducted to different treatment steps or, respectively, to the ambient atmosphere proceeding from the steamer. A meaningful arrangement and design of the application containers thereby makes it possible, for example, to treat only one side of the textile material with a specific chemical liquor before entry of the textile material into the steamer, to subsequently steam it, to then treat the opposite side—but potentially the same side as well—with a further, different chemical liquor following the steaming process, to subsequently carry out another steaming and, finally, to discharge the textile material into the atmosphere. Deriving therefrom are broad possibilities of variation in applications wherein different acting of different liquors on the two, opposite sides of the textile material or, on the other hand, a chronologically offset application of different chemical liquors separated by a steaming process or, potentially, the repeated treatment with a single chemical liquor are desirable for achieving specific effects. This embodiment of the invention is considered an especially important feature. Various variations in the arrangement of steamer and preceding or, respectively, following application container are possible within the idea of the invention. For example, one application container comprising two (or a multiple of two) nozzle crossbeams lying opposite one another can be provided with following steamer. In addition thereto, for example, a further application housing comprising nozzle crossbeam of the type and arrangement set forth above can follow the steamer. In both instances, it is also possible to provide only a single nozzle crossbeam for every application container instead of an application container comprising a plurality of crossbeams whereby, however, at least one application container must be present per side of the material web; in this case, too, multiples of two application containers (or, respectively, nozzle crosspieces) can be provided for each side of the material web, i.e., at each side of the steamer.

On the basis of different combinations of application containers, potentially having different structures, as well as steamer or steamers, the following methods, for example, can be implemented in the invention: single or multiple, two-sided chemical application of the same or different chemicals (whereby the same chemicals are provided or, respectively, can be provided for the sides of the textile material lying opposite one another), with following dwell for reaction (steaming); in addition to the afore-mentioned procedure, following the steaming, likewise a chemical application of the described type and direct supply of the textile material to following processes with only a short dwell time following the last chemical application; further, a procedure as recited above but with arbitrary combination of a plurality of chemical applications (with identical or different chemicals, whereby, however, the two sides of the textile material are respectively charged with the same chemical) and arbitrary dwell times between the various chemical applications (i.e., steaming times).

Further features and advantages of the invention derive from the claims and from the following description wherein exemplary embodiments are set forth in detail with reference to the schematic drawing.

DESCRIPTION OF THE PREFERRED EMBODIMENTS

Figure 1:
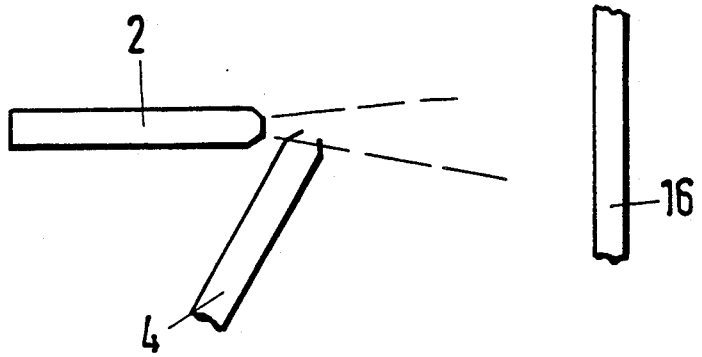
FIG. 1 is a cross sectional view of a first exemplary embodiment of an applicator of an apparatus of the invention taken in a plane extending perpendicular to the plane of the textile material to be treated.

In the exemplary embodiment shown in FIG. 1, the applicator comprises a first pipe 2 that is directed onto the textile material 16 and comprises a second pipe 4 whose front end discharges in the discharge region of the first pipe 2. Super-pressurized steam emerges from the first pipe 2; liquor that is not preheated or is only slightly preheated is applied through the pipe 4. A mixture of the steam emerging from the pipe 2 and of the liquor emerging from the pipe 4 is thus formed so that an aerosol is formed. This aerosol impacts the material 16 with high pressure and penetrates thereinto.

The fact that the liquor is not heated until immediately before impact on the textile material effects that the chemical reactions will occur only in the material itself. Here, however, the chemical conversion, for example that of the peroxide utilized in bleaching, occurs suddenly because of the high temperature of the steam.

Figure 2:
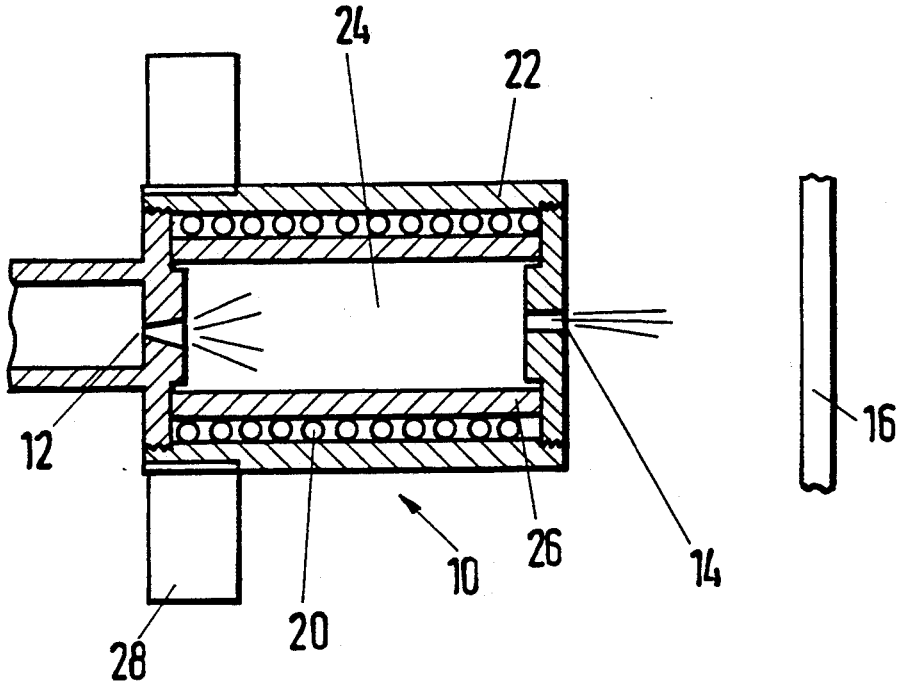
FIG. 2 is a cross sectional view similar to FIG. 1 of a second exemplary embodiment of an applicator of the invention.

In the exemplary embodiment shown in FIG. 2, the applicator—referenced 10 herein—is cylindrically fashioned; a first pipe 26 is terminated with a disc at both sides upon formation of a chamber 24. The one disc thereby forms the admission or inlet 12 and the other disc forms the discharge 14. The liquor is introduced into the chamber 24 through the admission 12. The first pipe 26 is embraced by a helical heating element 20; the heating element 20 is in turn accepted by a further pipe 22 that is screwed into a mount 28.

The liquor injected into the chamber 24 through the admission 12 is suddenly evaporated therein and emerges from the discharge 14 under high pressure while charging the material 16.

Figure 9:
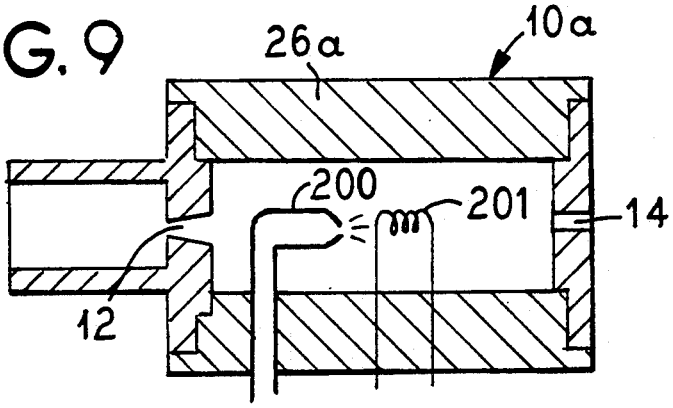
FIG. 9 is a cross sectional view of a modification of the embodiment of FIG. 2.

Instead of the heating element 20, an applicator 10*a* (FIG. 9) has a first pipe 26*a* with an arrangement for burning alcohol which includes a jet 200 for spraying alcohol into the chamber 24 and an ignitor 201. Thus, liquor injected into the chamber 24 will be evaporated by the heat created by the arrangement for burning alcohol.

Differing from the first exemplary embodiment, the aerosol in the second exemplary embodiment is thus formed in a closed chamber and this aerosol is then applied onto the material web 16.

Figure 3:
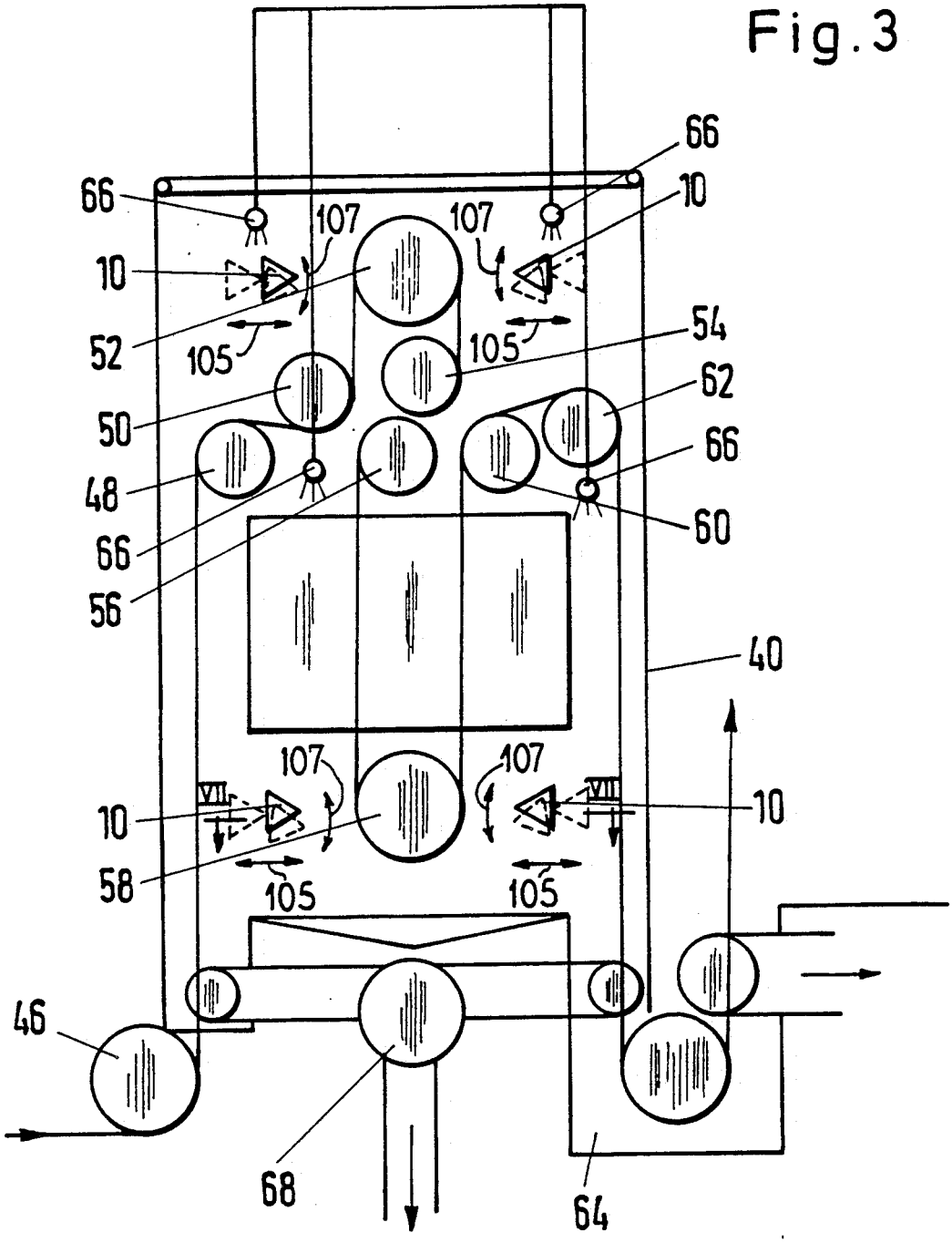
FIG. 3 is a schematic cross sectional view of an application container in a further exemplary embodiment of the invention, comprising applicators and a means for steam rinsing, said view being in a plane extending perpendicular to the plane of the textile material to be treated.

FIG. 3 schematically shows an exemplary embodiment of the application container 40 that accepts the applicators. The material web to be treated is introduced into the container 40 via a first roller 46. After passing deflection rollers 48, 50, the material web is supplied via an upper deflection roller 52. Applicators 10 fashioned in accord with the invention are arranged at both sides of this upper deflection roller 52, the material web being charged with the liquor particularly, thus, a solution containing peroxide, through these applicators 10. The material web is then conducted by further rollers 54, 56 around a lower deflection roller 58 in whose region the material web is again charged with the liquor via further applicators 10. After guidance over rollers 60, 62, the material web is then conducted out of the container 40 through a sluice 64 and is supplied to a traditional steamer for further treatment.

Figure 7:
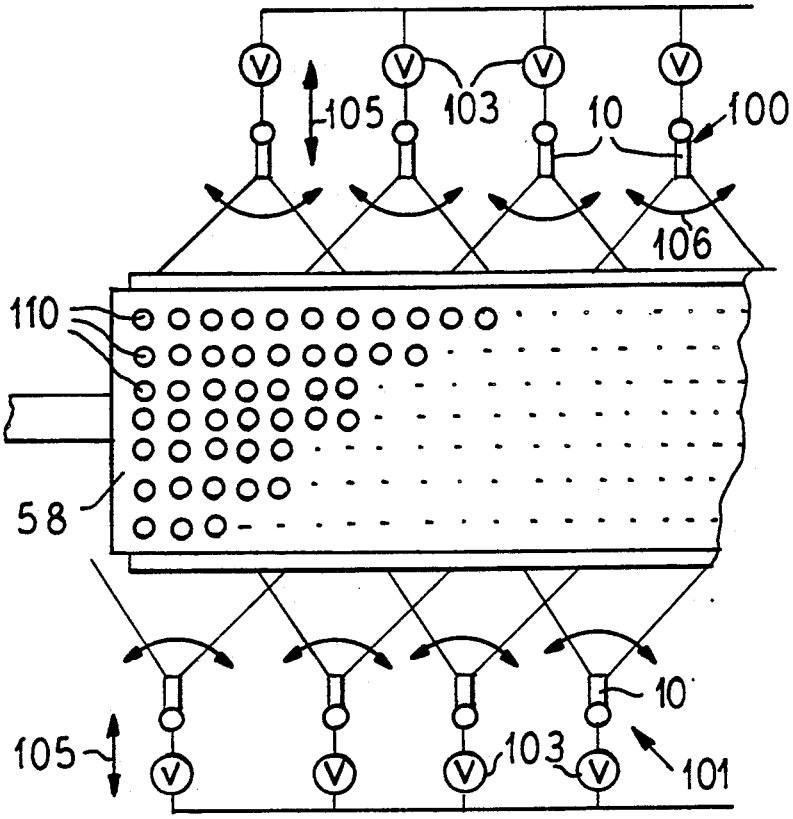
FIG. 7 is a diagrammatic view taken on line VII—VII of FIG. 3.

As illustrated in FIG. 7, the applicators 10 are arranged side-by-side in two facing rows 100 and 101 that extend parallel to the roller 58 and transverse to the conveying direction of the web. The jets emerging from the applicators 10 will overlap on the web or goods being treated. The applicators 10 of the row 100 are offset half the distance between two applicators relative to the applicators of row 101. Each applicator 10 has a separate controllable valve 103. Each row 100 and 101 can be moved in the direction of arrow 105 to change the spacing between the web and the applicators. Each applicator can be rotated in the direction of arrow 106 (FIG. 7) or arrow 107 (FIG. 2) to change the angle of attack.

Figure 8:
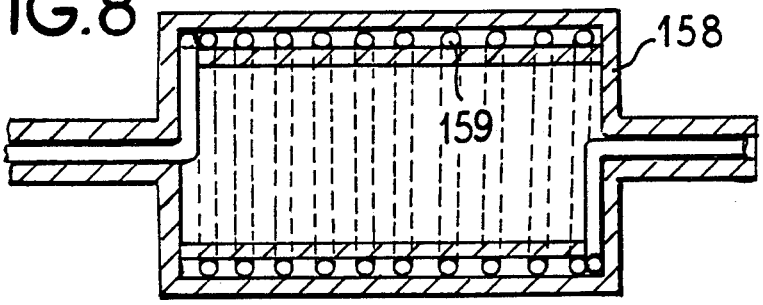
FIG. 8 is a cross sectional view of an embodiment of a roller of the invention.

As illustrated in FIG. 7, the roller 58 is a sieve roller with openings 110. However, the roller 58 could also be constructed as a heatable roller 158 (FIG. 8) which has a heating element 159.

For permanent rinsing of the interior of the container 40, this is fashioned with a plurality of steam entry pipes 66 that are preferably arranged above the applicators 10. A blower 68 is arranged in the lower region of the container 40, this blower in turn eliminating the steam introduced into the container 40 via the steam entry pipes 66 therefrom. Overall, of course, care is thereby exercised that the steam rinsing event in fact occurs under constant supply of steam into the container while preventing a "blow-back" of container atmosphere into the steam entry pipes.

It can thereby be seen in the apparatus of the invention that the application container 40 in which the liquor containing the peroxide or, respectively, a similar substance is applied onto the material web via the applicators 10 is separated from the actual steamer. What this spacial separation achieves is that the volume of the space that accepts the applicators can be relatively small. During operation, the container 40 accepting the applicators 10 is therefore constantly steam-rinsed, so that the peroxide that does not proceed onto the weave and which threatens to concentrate is constantly eliminated. An explosion is thus reliably prevented.

The liquor that has not been used on the textile material and that is eliminated from the container 40 in the steam rinsing is preferably recirculated, whereby these chemicals are not only prevented from proceeding into the atmosphere in an environmentally safe fashion but the economic feasibility can also be considerably increased.

Figure 4:
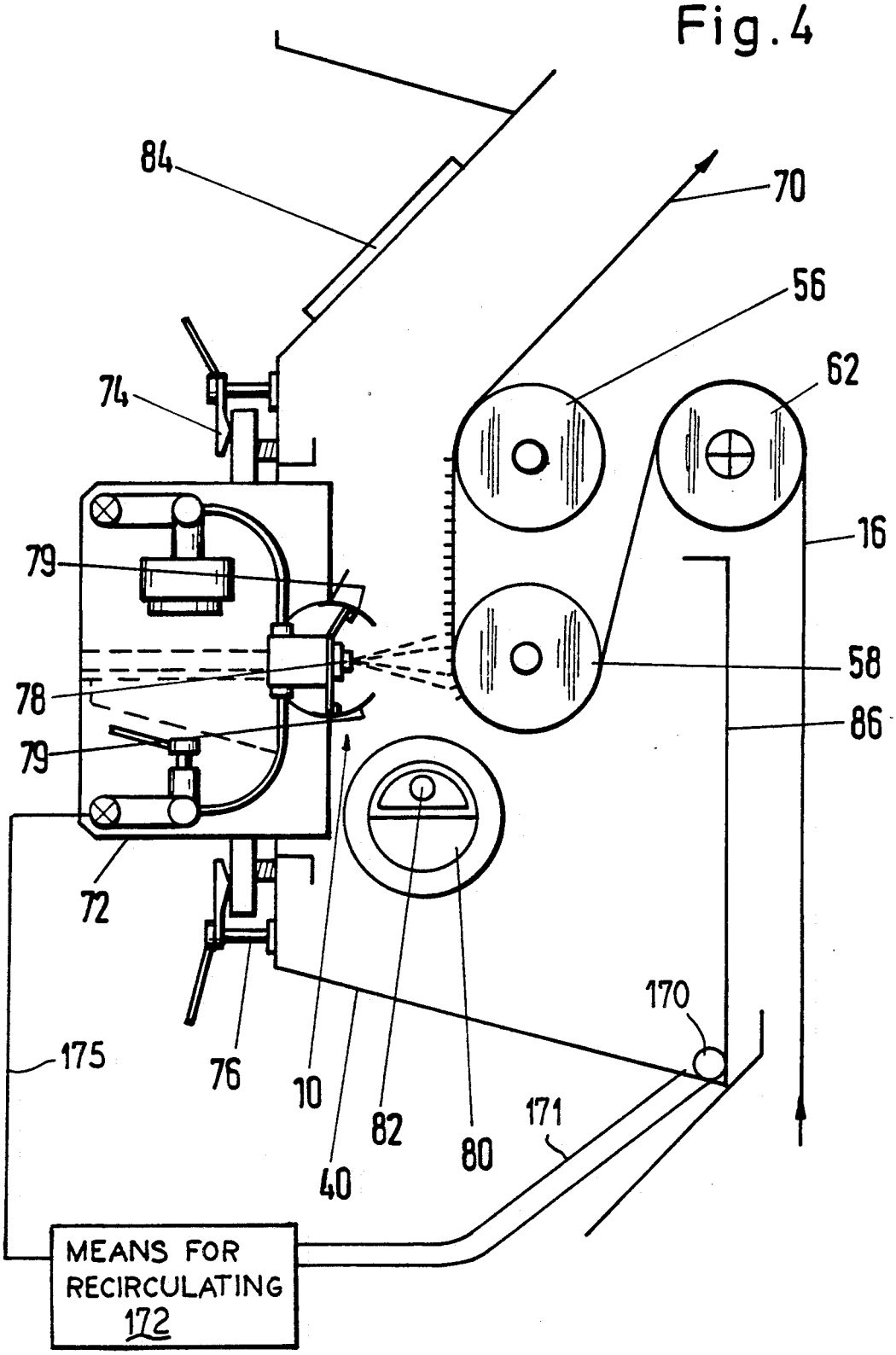
FIG. 4 is a cross sectional view of a further exemplary embodiment of the invention in an illustration corresponding to FIG. 3.

In the exemplary embodiment shown in FIG. 4, the textile material 16 becomes the content of the application container 40 obliquely from the lower right as seen in the drawing, as in the exemplary embodiment of FIG. 3, is conducted obliquely toward the upper right through the application container 40 that it then departs in the direction of the arrow 70 to the steamer (not shown in FIG. 4). All inside walls of the application container 40 are either vertical or, on the other hand, are arranged at an angle of at least 30° relative to the horizontal, so that attaching droplets that unite to form larger drops cannot drip down but run along the wall and can thus be eliminated in a way that is non-injurious for the textile material 16. The nozzles or, respectively, applicators 10 are arranged in a nozzle crosspiece 72 that, as an integrated structural unit, is inserted into a corresponding opening in the wall of the application container 40, being inserted replaceably therein with rapid-action closures 74, 76. Only a nozzle end 78 from which a nozzle jet emerges is thereby situated in the interior of the application container 40, whereas the remaining component parts such as conduits, screwed connections, valves, etc., are freely accessible from the outside, i.e., proceeding from the ambient atmosphere, in the way to be seen from the drawing. The nozzle jet emerging from the nozzle end 78 is stopped down such by covering 79—fashioned, for example, as a sheet metal ply—that chemical liquor can in fact proceed essentially only onto the textile material 16 and can satisfy its intended purpose there.

Windows 80 with lamps 82 in order to be able to illuminate the nozzle jets are attached at the bearing sides of the rollers 56, 58, 62, i.e., in the corresponding end walls of the application container 40, parallel to the plane of the drawing of FIG. 4. Slanting viewing windows 84 are present over the entire width of the apparatus above the nozzle crosspiece 72. Together with the illumination, thus, a continuous optical monitoring of the nozzle jets is possible during operation. Of course, it would also be possible to undertake an automatic monitoring, for example, with appropriate sensors and control devices, instead of a purely optical monitoring by an operator.

As may be seen in FIG. 4, a partition plate 86 is provided opposite the nozzle crosspiece 72, this partition plate 86 preventing droplets that rebound off the roller 58 from proceeding directly onto the textile material 16.

The nozzle jet, moreover, emerges such from the nozzle end 78—the nozzles are rotatably attached around their center fastening point, as a result whereof an improved flexibility in view of the adjustment for various articles of material derives—that the nozzle jet impacts approximately in the seating or, respectively, contact region of the textile material 16 with the roller 58. As a result of this type of impact, preferably immediately behind the corresponding contact line in conveying direction of the textile material 16, a "suction effect" is exploited that is based on a slight expansion of the textile material 16 after it passes the roller 58, as a result whereof an especially intense penetration of the material with the chemical liquor is guaranteed.

As illustrated, a drain 170 is connected by a pipe 171 to means 172 for recirculating the liquor constituents. From the means 172 for recirculating, the liquor is taken by a line 175 back to the supply for the applicator 10.

Figure 5:
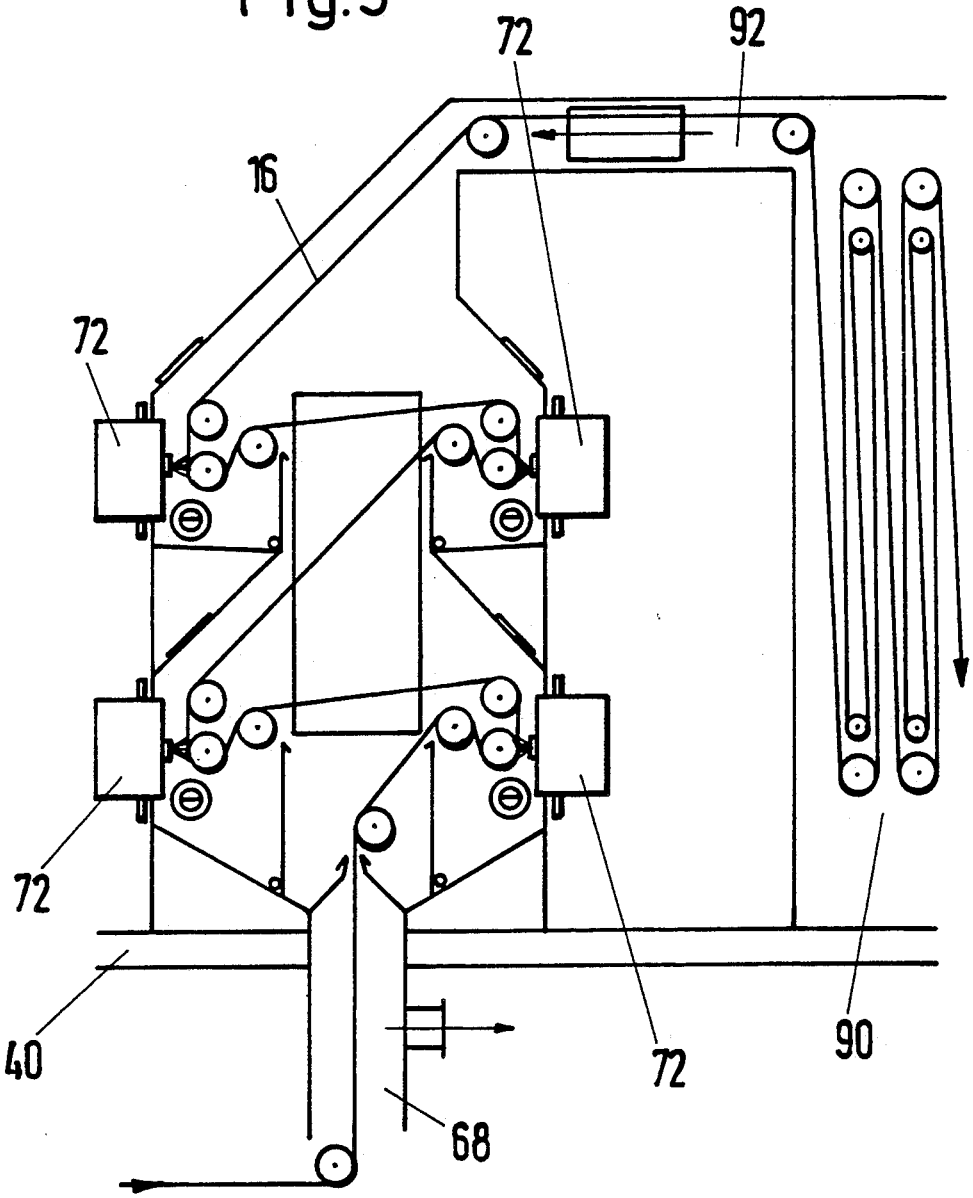
FIG. 5 is a cross sectional view of a further, modified exemplary embodiment of an apparatus of the invention in an illustration corresponding to that in FIGS. 3 and 4.

It may be seen in the exemplary embodiment shown in FIG. 5 that the application container 40 is followed by a steamer 90 whose atmosphere is in communication with the application container 40 via a spill shaft 92 that is closed off from the ambient atmosphere. Steam from the steamer 90 that resides under slight over-pressure in comparison to the application container 40 constantly flows into the application container 40 through the spill shaft 92 that the material traverses from left to right in FIG. 5 and is employed for steam rinsing in said application container 40 in the way already set forth in conjunction with FIG. 3. The steam flows through the spill shaft in counter-current flow to the textile material 16 in this exemplary embodiment. The application container comprises a total of four nozzle crosspieces 72 of the type already described, whereby the extraction of the mixture of vapor, chemicals and air from the interior of the application container 40 ensues with the blower 68. The nozzle crosspieces 72 are, so to speak, allocated to the application container 40 in the form of individual chambers, whereby it is guaranteed that the two sides of the textile material 16 lying opposite one another are uniformly charged and no drops from the walls or pipelines of the application container 40 proceed onto the weave of the textile material 16. As may be seen from the drawing, respectively two crosspiece housings of the nozzle crosspieces 72 lying opposite one another belong together, i.e., the seen chemical liquor is applied onto the textile material 16 in them. An application container of the type shown in FIG. 5 and described above can be expanded in stages, i.e., both two as well as four, six and more nozzle crosspieces 72 in a single application container 40 are conceivable when the successive application of different chemicals is necessary for the process.

Figure 6:
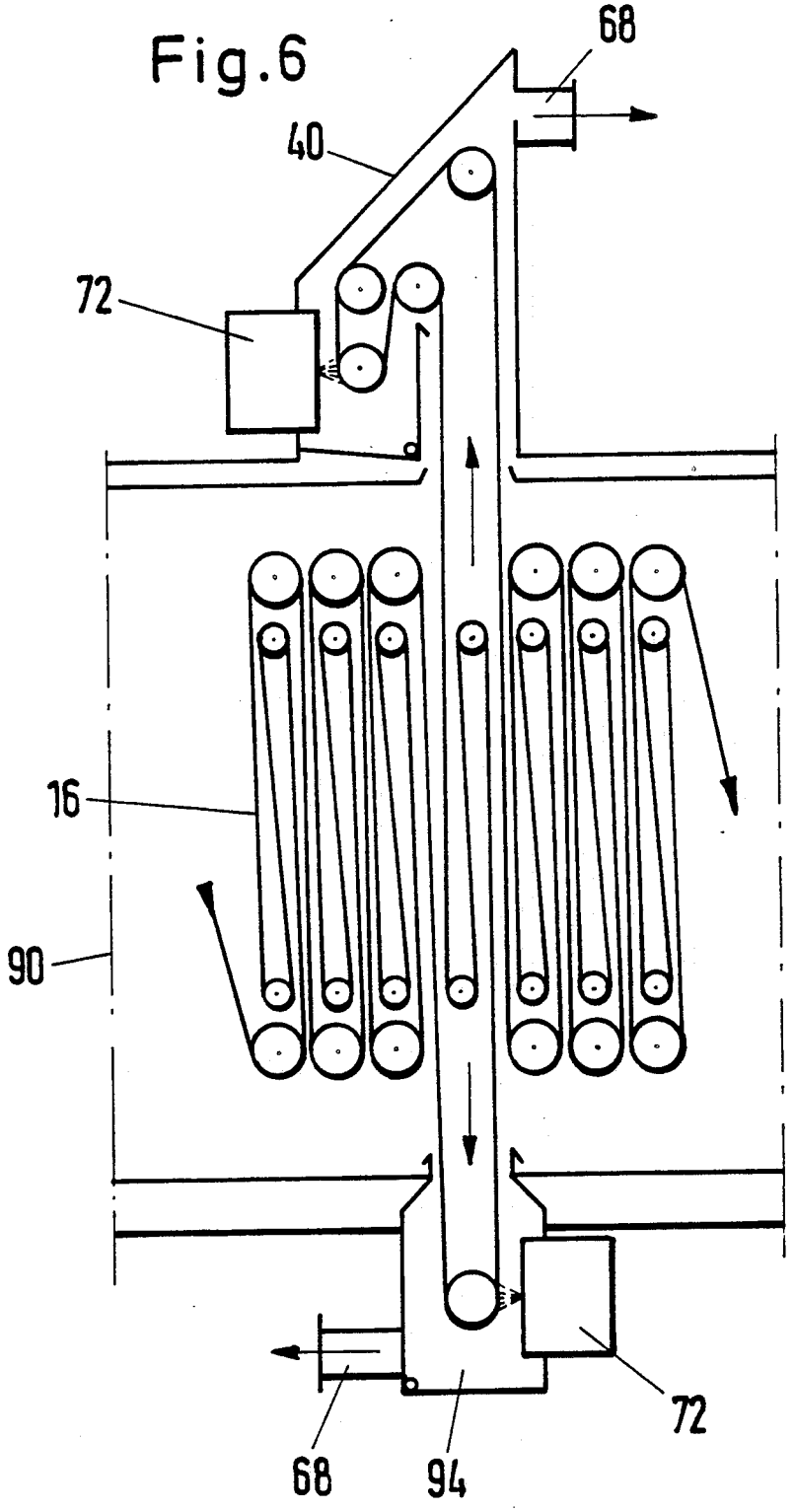
FIG. 6 is a cross sectional view of a further modified exemplary embodiment of an apparatus of the invention in an illustration corresponding to that in FIGS. 3–5.

Such an application container comprising two of a plurality of nozzle crosspieces 72 can be attached both at the input of the steamer 90 as well as at its output when it is advantageous for the process. In the exemplary embodiment of FIG. 6, what is involved is an embodiment of the apparatus of the invention wherein the steamer 90 has a first application container 40 and a further application container 94 allocated to it, each of these comprising a single nozzle crosspiece 72. Every application container has an extraction fan 68 of the type already set forth allocated to it. With the apparatus shown in FIG. 6, the textile material 16 can dwell in the steamer 90 for reaction both before as well as after a specific chemical application. Here, too, a serial joining of 2, 4, 6 or a multiple of crosspieces 72 or, respectively, "application chambers" is possible in the respective application container 40 or, respectively, 94.

A continuous steam flow from the steamer 90 to the application container 40 or, respectively, to the further application containers 94 can be assured in that the steamer 90 is supplied with steam with a constantly controlled inflow. Since the textile material 16 and the liquor are already heated, only the losses over the surface that are independent of the textile material occur in the steamer 90 apart from the flow-off of steam through the spill shaft 92 as steam consumption. A supervision to see whether a droplet fog penetrates from the application container 40 or, respectively, 94 into the steamer 90 can ensue optically by the operator when the system is started up. Of course, a sensor-controlled control is also possible. The extraction with the extractor fan 68 ensues with a constant volume stream. The steam offering to the extractor that differs dependent on the articles of material is compensated by a more or less pronounced intake of ambient air.

The features of the invention disclosed in the above specification, in the drawing as well as in the claims can be critical for realization of the various embodiments of the invention both individually as well as inarbitrary combinations.

We claim:

1. In an apparatus for wet-treating a web of textile goods, said apparatus comprising a container in which the web to be treated is conducted over a plurality of rollers and is exposed to the influence of a liquor; at least one applicator being arranged in the container adjacent to the web of the goods, said applicator comprising an inlet for the liquor to be applied onto the goods, means for applying thermal energy for the formation of an aerosol of the liquor and discharge means for directing the aerosol, which was formed in the applicator, under high pressure onto the textile goods conducted past the applicator; and said apparatus having means for steam treatment of the textile goods charged with the liquor, the improvements comprising the container being provided with means for steam rinsing the interior of the container, said means for steam treatment being composed of a steamer and said apparatus having a sluice to spatially separate the steamer from the container.

2. In an apparatus according to claim 1, wherein the means for steam rinsing of the container is composed of a plurality of steam entry pipes and of an exhaust blower connected to said container.

3. In an apparatus according to claim 1, wherein the volume of the container is small in relationship to that of the steamer.

4. In an apparatus according to claim 1, wherein the applicator is a multi-substance nozzle.

5. In an apparatus according to claim 4, wherein the multi-substance nozzle is a nozzle having interior mixing.

6. In an apparatus according to claim 4, wherein the multi-substance nozzle is a nozzle having exterior mixing.

7. In an apparatus according to claim 1, wherein a plurality of applicators, which are arranged side-by-side, is provided essentially transversely relative to the conveying direction of the goods, and wherein aerosol jets emerging from the applicators overlap on the goods to be treated.

8. In an apparatus according to claim 7, which has at least two rows of said applicators, whereby the individual rows are offset relative to one another by half the distance between two applicators.

9. In an apparatus according to claim 7, wherein each applicator is provided with a controllable valve.

10. In an apparatus according to claim 1, wherein a spacing between the applicator and the web of the goods is adjustable for setting the point of incidence of the liquor onto the goods.

11. In an apparatus according to claim 1, wherein an arrangement and alignment of the applicator is such that, when resting on one of the rollers, the web is charged with the liquor in a conveying direction of the web following the contact line between web and roller surface.

12. In an apparatus according to claim 11, wherein the roller on which the goods lie when being charged with the liquor is a sieve roller.

13. In an apparatus according to claim 11, wherein the roller on which the goods lies when being charged with the liquor is a heatable roller.

14. In an apparatus according to claim 1, which includes means for recirculating the liquor constituents conducted out of the container during steam rinsing into the liquor to be delivered to the textile goods.

15. In an apparatus according to claim 1, wherein steam overflowing from the steamer into the application container under slight over-pressure is employed for steam rinsing the application container.

16. In an apparatus according to claim 1, wherein a delivery of the steam from the steamer into the container is controllable.

17. In an apparatus according to claim 1, wherein the means for supplying thermal energy enables the introduction of water or steam residing under excess pressure.

18. In an apparatus according to claim 1, wherein the applicator comprises two unary nozzles directed onto the same point.

19. In an apparatus according to claim 1, wherein the applicator is provided with at least one atomizer.

20. In an apparatus according to claim 1, wherein the means for supplying thermal energy is a heating element.

21. In an apparatus according to claim 20, wherein the heating element is a heat exchanger.

22. In an apparatus according to claim 20, wherein the heating element is an electrical heating element.

23. In an apparatus according to claim 20, wherein the heating element is an arrangement for burning alcohol.

24. In an apparatus according to claim 1, wherein the discharge means is a slotted nozzle.

25. In an arrangement according to claim 1, wherein the applicator is a cylindrical structure with two end faces, with one end face having the inlet and the other end face having the discharge means.

26. In an apparatus according to claim 25, wherein the means for supplying thermal energy is a helical heating element surrounding a chamber whereby the chamber and heating element are accepted in an outer pipe.

27. In an apparatus according to claim 1, wherein the sluice comprises a spill shaft that connects the application container to the steamer, the web is guided within said spill shaft between the application container and the steamer and said spill shaft being tranversed by the steam that flows over from the steamer into the application container.

28. In an apparatus according to claim 27, wherein the steam flows through the spill shaft in counter-current flow relative to the conveying direction of the web.

29. In an apparatus according to claim 1, wherein all walls of the application container with the exception of the floor describe an angle of 30° through 90° with the horizontal.

30. In an apparatus according to claim 1, wherein cover plates protect the applicator against a penetration of chemical liquor running down the container walls into a nozzle jet of the applicator.

31. In an apparatus according to claim 1, wherein the applicator comprises a nozzle crosspiece releasably insertable into an applicator opening of the application container wall, with rapid-action closures, the nozzle being arranged in said nozzle crosspiece so that only a nozzle end is exposed to the atmosphere in the application container, whereas the remaining component parts of the applicator including a nozzle body and connecting lines lie in the ambient atmosphere.

32. In an apparatus according to claim 31, which includes means for arranging the web so that no potential condensation surface and liquor conduit proceeds above the web.

33. In an apparatus according to claim 32, which includes at least one partition plate for preventing the direct impact of rebounding droplets of chemical liquor onto the web.

34. In an apparatus according to claim 31, which includes optical illumination and monitoring devices for the nozzle end of at least one nozzle crosspiece.

35. In an apparatus according to claim 31, wherein the individual nozzles of the nozzle crosspiece are rotatable around their center fastening point.

36. In an apparatus according to claim 31, wherein two nozzle crosspieces are provided in pairs lying opposite one another in vertical sidewalls of the application container that lie opposite one another.

37. In an apparatus according to claim 1, wherein at least two application containers are allocated to the steamer.

38. In an apparatus according to claim 37, wherein the web from all application containers is first respectively conducted to the steamer and is only conducted from the latter to further treatment stations or, respectively, to the ambient atmosphere.

39. In an apparatus according to claim 1, wherein an extraction device conveys a mixture of substances deriving from the application container and ambient air varying in composition dependent upon the steam offering, said device conveying this with a constant volume stream and constant under-pressure.

40. In an apparatus according to claim 1, wherein the applicator is provided with a controllable valve.

41. In an apparatus according to claim 1, wherein an angle between the applicator and the web is adjustable to enable setting a point of incidence of the liquor into the web.

* * * * *